United States Patent [19]

Fisher, Jr. et al.

[11] 4,436,152

[45] Mar. 13, 1984

[54] SHIFTING TOOL

[75] Inventors: Ernest P. Fisher, Jr.; William R. Welch, both of Carrollton, Tex.

[73] Assignee: Otis Engineering Corporation, Dallas, Tex.

[21] Appl. No.: 422,739

[22] Filed: Sep. 24, 1982

[51] Int. Cl.[3] ..... E21B 23/00

[52] U.S. Cl. ..... 166/214; 166/237; 166/382; 285/2

[58] Field of Search ..... 166/237, 381, 382, 208, 166/214; 285/1, 2

[56] References Cited

U.S. PATENT DOCUMENTS

| | | | |
|---|---|---|---|
| 3,051,243 | 4/1962 | Grimmer et al. | 166/332 |
| 3,552,718 | 3/1968 | Schwegman | 166/332 X |
| 3,606,296 | 4/1969 | Schwegman | 166/383 |
| 3,845,815 | 11/1974 | Garwood | 166/319 X |
| 3,874,634 | 4/1975 | Gazda | 251/319 |
| 3,990,511 | 11/1976 | Gazda | 166/332 X |
| 4,043,392 | 8/1977 | Gazda | 166/217 |
| 4,161,984 | 7/1979 | Watkins | 166/382 |
| 4,378,839 | 4/1983 | Fisher | 166/382 X |

*Primary Examiner*—Ernest R. Purser
*Assistant Examiner*—Michael Starinsky
*Attorney, Agent, or Firm*—Roland O. Cox

[57] ABSTRACT

An improved shifting tool connectable in a well tool string and useful to engage and position a slidable sleeve in a sliding sleeve device in a well flow conductor. The selectively profiled shifting tool keys provide better fit with and more contact area between keys and slidable sleeves. When the engaged slidable sleeve cannot be moved up and the shifting tool is not automatically disengaged, emergency disengagement means may be utilized by applying upward force to the shifting tool sufficient to shear pins and cause all keys to be cammed inwardly at both ends to completely disengage for removal of the shifting tool from the sliding sleeve device.

5 Claims, 5 Drawing Figures

SHIFTING TOOL

This invention relates to well tools and in particular to shifting tools used to operate sleeve type devices which are connected in well flow conductors within a well.

Many sleeve type devices are used in well flow conductors for control of well fluids within wells both during well completion and well production operations. Each of these sleeve type devices (most of which are valves) requires a shifting tool, also sometimes called a positioning or operating tool, which is lowered in the well to engage and move axially and reposition an internal slidable sleeve in the sleeve device to operate or actuate the device. A number of such shifting tools are shown in U.S. Pat. Nos. 3,051,243; 3,552,718; 3,606,926; 3,845,815; 3,874,634; 3,990,511; and 4,043,392.

The sleeve shifter disclosed in U.S. Pat. Nos. 3,874,634, 3,990,511, and 4,043,392 has been found to be complicated by a multiplicity of parts requiring extensive machining resulting in greater manufacturing and assembly costs. These shifters are of the type having two selectively profiled keys which will engage only a slidable sleeve with a mating internal profile as described in detail in U.S. Pat. No. 4,043,392. After engaging a particular slidable sleeve, the shifter is moved up or down to properly reposition (shift) the sleeve to operate the device.

During normal sleeve shifting operations, camming surfaces inside the sliding sleeve device cam the shifting tool keys out of engagement with the slidable sleeve automatically when the sleeve is completely repositioned. Infrequently, the slidable sleeve sticks and the shifter keys are not automatically disengaged from the sleeve. These shifting tools are equipped with emergency key retracting means which may be utilized when needed by pulling or jarring up on the shifting tool to shear screws and cause relative movement of shifting tool parts which apply camming forces to retract the upper end of their pivotable keys to disengage a slidable sleeve, and on removal from the sleeve, the partially retracted key frequently drags in and wears the sleeve inducing bending stresses in the key, or may damage the slidable sleeve or key or both, shortening both key and sleeve life. Also, loose pieces of sheared screws may fall onto and foul equipment below in the flow conductor, and realignment of the shifter parts is difficult on surface for replacement of sheared screws.

The shifting tool of the present invention consists of simplified parts requiring less machining. Each such shifting tool is provided with four keys, each of which is cammed inwardly to retract at both ends and do not pivot at one end, providing complete key retraction and disengagement for easy removal from a sleeve device when sheared to release. Since the keys in the tool of this invention do not pivot, geometry of the tool allows the keys to be thicker and stronger with profiles affording greater contact areas with slidable sleeve profiles resulting in less stress, damage and wear.

One object of this invention is to provide an improved shifting tool comprised of a reduced number of simplified parts.

Another object of this invention is to provide an improved shifting tool having stronger keys with greater and better fitting key-slidable sleeve engaged area.

Also, an object of this invention is to provide an improved shifting tool wherein each key may be completely retracted for emergency disengagement and unstressed free removal from a sliding sleeve device.

Figure 1:
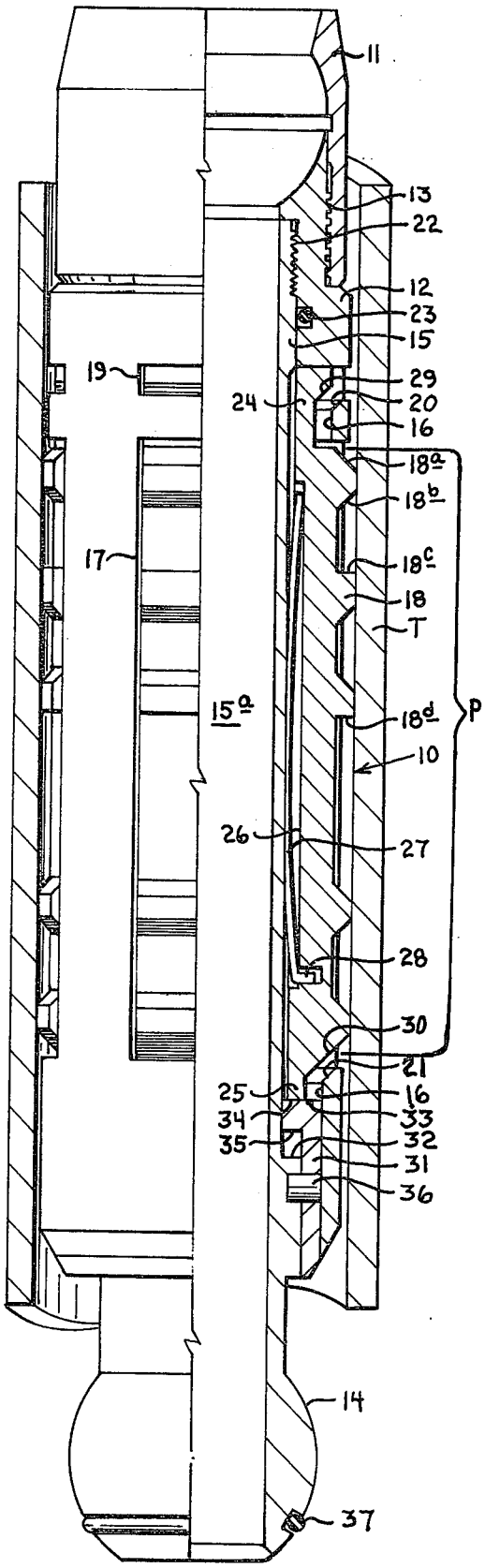
FIG. 1 is a view, in elevation and one-half section, of the shifting tool of this invention being lowered into or retrieved from a well flow conductor.

FIG. 1 shows the improved shifting tool 10 of this invention in the preferred form, which has been connected at the surface into a well tool string (not shown) and is being lowered into (or retrieved from) a well flow conductor T. The shifting tool was connected into the well tool string at its upper end with swivel connector cap 11, which is threadedly connected to key mandrel 12 at thread 13 and at its lower end connected with swivel connector ball 14 formed on the lower end of tool mandrel 15 which has a bore 15*a*. The key mandrel has an internal bore 16 and four longitudinal windows 17 spaced at 90 degrees, wherein radially movable keys 18 are fitted. Each window has an aligned, vertically spaced cross slot 19 above. Each slot is provided with a camming surface 20, and each window is provided with a camming surface 21. The upper end of the tool mandrel is threadedly attached inside the key mandrel with thread 22 and sealed thereto with resilient seal 23. A particular profile P is cut along the outside surface of each key which will only engage a mating profile in a sleeve device sleeve. Profiles P on keys 18 include camming surfaces 18*a* and 18*b*, up shifting shoulder 18*c* and down shifting shoulder 18*d*. Each key is provided with an upper extended portion 24 and a lower extended portion 25 to retain each key in its window. A groove 26 is provided in the inside surface of each key to house a leaf spring 27 which is positioned therein by one end of the spring protruding into a hole 28 in each key. Each key is also provided with an upper camming surface 29 and a lower camming surface 30 adjacent their extended portions which are engageable with slot camming surface 20 and window camming surface 21, respectively. A sleeve 31 is positioned in the key mandrel bore around an enlarged portion of the tool mandrel on which a shoulder 32 is formed. The sleeve end surface 33 is engageable with surface 34 on extended key portion 25. The sleeve is provided with an internal shoulder 35 and is retained in spaced position above the tool mandrel shoulder with frangible pins 36. A resilient seal 37 is provided on swivel connection ball 14 on the lower end of the tool 10 to seal it to the mating swivel connection cap in the well tool string.

Figure 2:
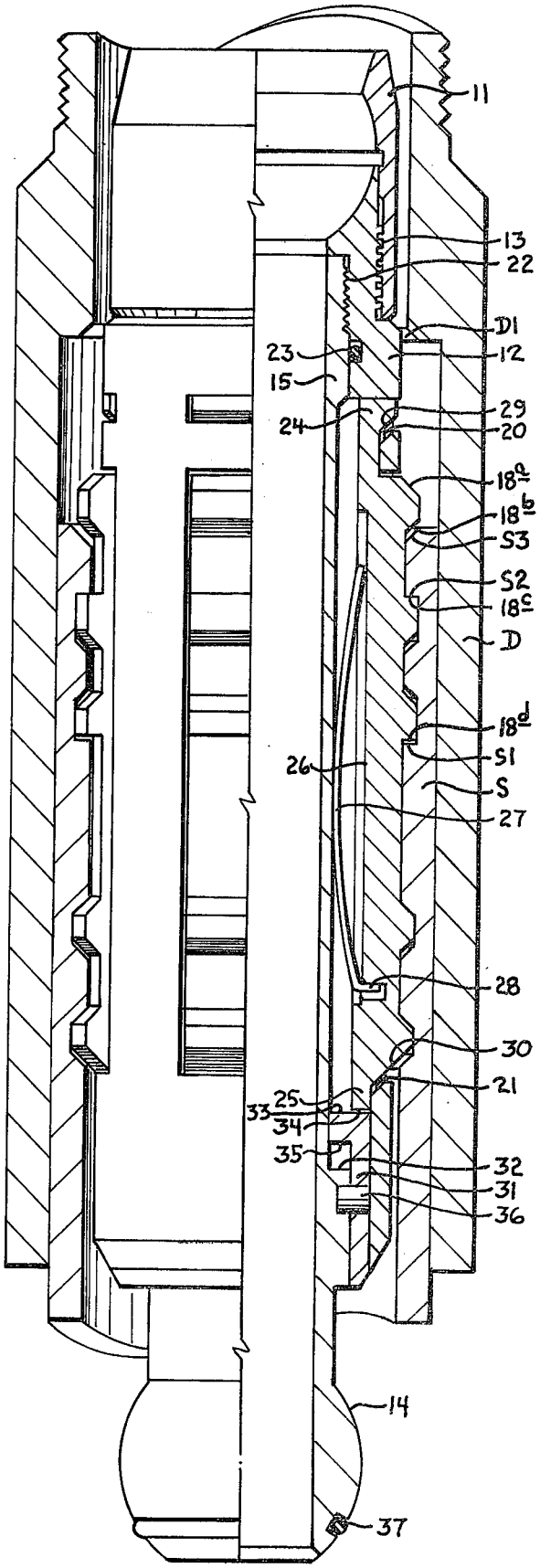
FIG. 2 is an elevation view, in one-half section, of the improved shifting tool of the present invention shown engaging the upper portion of a mating slidable sleeve in the upper portion of a sliding sleeve device.

To utilize, the tool 10 is connected into a well tool string (not shown) on surface and lowered into a well flow conductor T as shown in FIG. 1. Although the connections (cap 11 and ball 14) shown in the various drawing figures are connections of the type used within pumpdown or through flow line (TFL) well tool strings, any appropriate upper and lower connections may be provided. As the tool 10 enters the upper end of the flow conductor, the keys 18 are cammed inwardly and retained by the smaller inside diameter of the flow conductor, and spring 27 is forced to flatten in proportion. The outward force the flattened spring exerts on each key causes the outside key surfaces to "drag" the inside of the flow conductor as the tool is lowered into the conductor and to move outwardly into and engage any mating profile encountered in a slidable sleeve S in a sliding sleeve device D in the conductor while being lowered, as shown in FIG. 2. As the slidable sleeve was positioned up before engagement, down movement of the shifting tool has moved the slidable sleeve down through engaged down shoulder 18*d* and sleeve shoulder S1, operating the device. Usually when a shifting tool is removed upwardly from a sleeve device, engaged up shoulder 18*c* and slidable sleeve shoulder S2 move the sleeve up until camming surface D1 contacts camming surface 18*a*. Further upward movement of the sleeve cams surfaces 18*a*, moving each key inwardly, and automatically disengaging the keys from the slidable sleeve on sufficient up travel of the sleeve.

Figure 3:
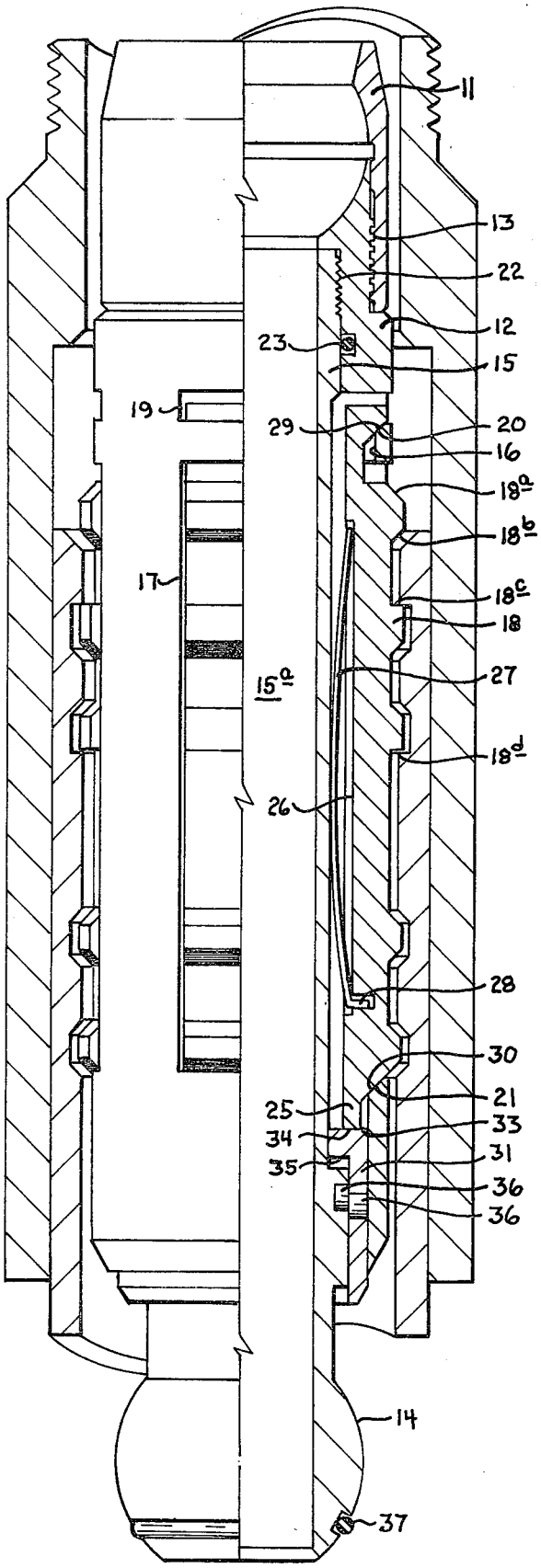
FIG. 3 is a half-sectioned elevational view of the tool of this invention actuated for emergency disengagement and partially disengaged from a slidable sleeve.
Figure 4:
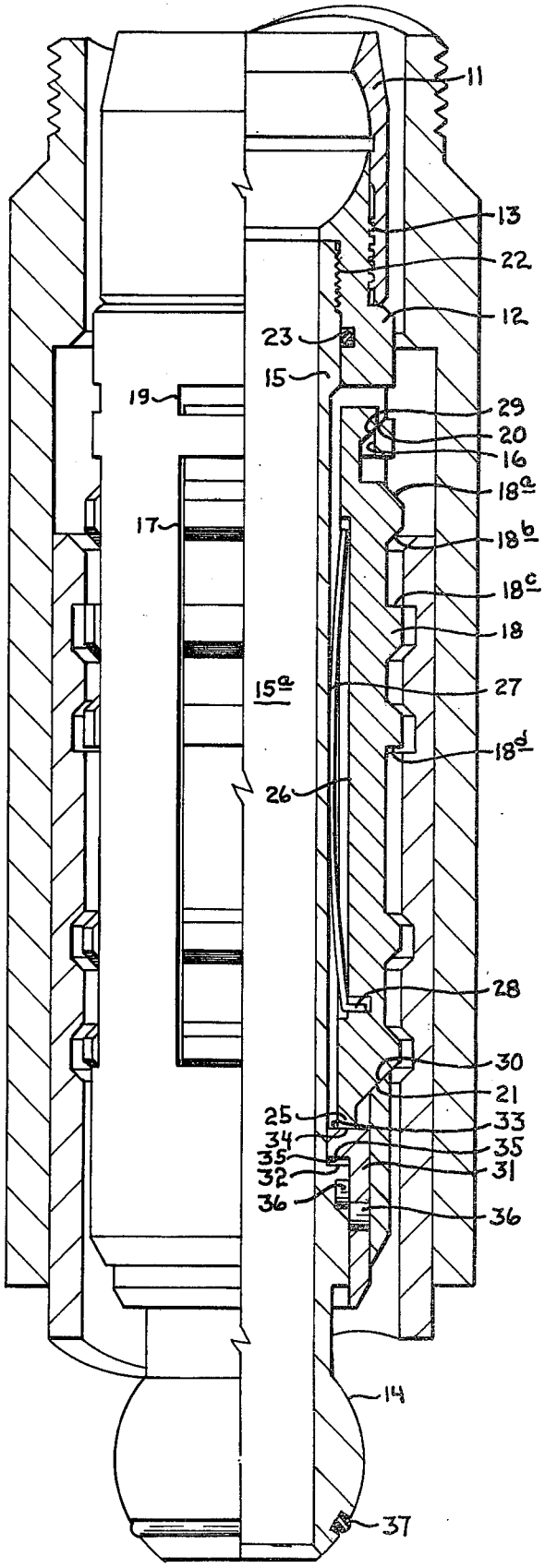
FIG. 4 is a view similar to FIG. 3 showing the improved shifting tool completely disengaged and ready to be removed from a sliding sleeve device.

When a slidable sleeve is stuck or cannot be moved up and repositioned for future operation of the sliding sleeve device and the positioning tool is not automatically disengaged, emergency disengagement may be accomplished by jarring up or pulling on the upper end of the tool mandrel 15 and key mandrel 12 through the swivel cap 11. As square shoulder 18*c* on each key engages the mating shoulder in the slidable sleeve, which cannot be moved up, the keys are held down and sleeve 31 is moved up through pins 36 engaging sleeve surface 33 and key portion surface 34 at the lower end of each key, loading the pins in shear. Continued application of upward force on mandrel 15 starts shearing the pins (FIG. 3), moving the tool mandrel and attached key mandrel up slightly with reference to the stationary keys, to start camming both ends of each key inwardly to retract and disengage by engaging slot camming surfaces 20 with key camming surfaces 29 and window camming surfaces 21 with lower key camming surfaces 30. Continued upward movement of the tool mandrel shears the pins while each key is cammed at both ends and retracted, further flattening springs 27. Mandrel shoulder 32 moves toward sleeve shoulder 35 (FIG. 4), and the keys retract and disengage from the slidable sleeve profile. As the outside diameter over the keys has been reduced to the inside diameter of the mating slidable sleeve, the shifting tool may be freely removed upwardly from the slidable sleeve and sliding sleeve device and retrieved from the well flow conductor.

On the surface, sleeve 31 may be repositioned and sheared pins 36 replaced and the shifting tool used repeatedly to operate sliding sleeve devices utilizing the emergency release means as required.

Figure 5:
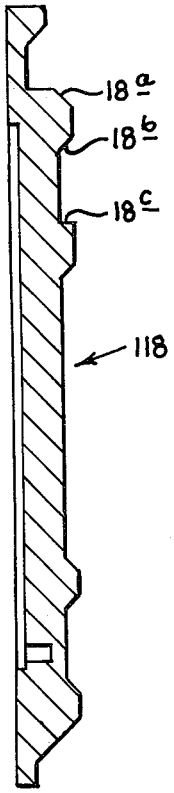
FIG. 5 shows an alternate key in section which may be used in the improved shifting tool.

The profile P on alternate keys 118, FIG. 5, includes all surfaces of key 18 profiles except downshifting shoulder 18*d*. The alternate keys are useful only in moving a slidable sleeve up from the down position and may be fitted into the key mandrel windows for use on the shifting tool of this invention.

We claim:

1. An improved shifting tool connectable in a well tool string for operating a sliding sleeve device, comprising:

a. an inner tubular mandrel;

b. an outer key mandrel secured in concentric spaced relation around said tubular mandrel, said key mandrel having a plurality of windows and an equal number of slots, said slots being spaced vertically above and aligned with each window, each slot and each window having a camming surface along the lower surface thereof;

c. a selectively profiled key disposed for radial movement in each of said windows, each said key having an upper extended portion and a lower extended portion, each upper extended key portion having a camming surface engageable with said slot camming surface and each lower key extended portion having a camming surface engageable with said window camming surface;

d. means between said keys and said inner mandrel biasing said keys outwardly; and e. releasable holding means between said inner mandrel and said lower key extended portion retaining said keys in a radially movable position and said camming surfaces disengaged, said holding means being releasable when an upward force in excess of a predetermined value is applied to said mandrels when said shifting tool is engaged with a sliding sleeve device whereby said camming surfaces are engaged at both ends of each key camming said keys inwardly to disengage from said sliding sleeve device.

2. The shifting tool of claim 1 wherein said releasable holding means comprise a sleeve disposed around the lower shoulder on said inner mandrel, said sleeve having an internal shoulder therein, and frangible pins holding said sleeve internal shoulder a spaced distance above said lower mandrel shoulder.

3. The shifting tool of claim 2 wherein said key profiles each include spaced downshifting and upshifting shoulders thereon.

4. A shifting tool in accordance with claim 3 wherein said key profiles include an upshifting shoulder only.

5. The shifting tool of claim 4 wherein said means biasing each key outwardly is a spring.

* * * * *